US012352525B2

(12) United States Patent
Trpkovski et al.

(10) Patent No.: US 12,352,525 B2
(45) Date of Patent: Jul. 8, 2025

(54) MODULAR STOCK FOR A WEAPON

(71) Applicant: Ravin Crossbows, LLC, Superior, WI (US)

(72) Inventors: Paul Trpkovski, Kailua Kona, HI (US); Dayne Lester, Sunriver, OR (US); Joshua Hanzel, Kailua Kona, HI (US)

(73) Assignee: RAVIN CROSSBOWS, LLC, Superior, WI (US)

( * ) Notice: Subject to any disclaimer, the term of this patent is extended or adjusted under 35 U.S.C. 154(b) by 0 days.

(21) Appl. No.: 18/231,197

(22) Filed: Aug. 7, 2023

(65) Prior Publication Data

US 2024/0133656 A1 Apr. 25, 2024
US 2024/0230273 A9 Jul. 11, 2024

Related U.S. Application Data

(63) Continuation of application No. 17/571,315, filed on Jan. 7, 2022, now Pat. No. 11,719,505.

(60) Provisional application No. 63/136,573, filed on Jan. 12, 2021, provisional application No. 63/134,957, filed on Jan. 7, 2021.

(51) Int. Cl.
*F41B 5/12* (2006.01)
*F41B 5/06* (2006.01)

(52) U.S. Cl.
CPC ..... *F41B 5/123* (2013.01); *F41B 5/066* (2013.01); *F41B 5/12* (2013.01)

(58) Field of Classification Search
CPC ..... F41B 5/12; F41B 5/126; F41B 5/066
See application file for complete search history.

(56) References Cited

U.S. PATENT DOCUMENTS

| | | | | |
|---|---|---|---|---|
| 5,522,373 | A | 6/1996 | Barnett | |
| 5,544,641 | A * | 8/1996 | Jenn | F41G 1/467 124/52 |
| 6,763,817 | B2 * | 7/2004 | Nickell | F41B 5/123 124/25.5 |
| 8,899,221 | B2 * | 12/2014 | Barnett | F41B 5/066 224/916 |
| 9,121,659 | B1 | 9/2015 | Chang | |
| 9,568,269 | B1 | 2/2017 | Chang | |
| 9,689,639 | B1 | 6/2017 | Liu | |
| 10,139,190 | B1 | 11/2018 | Trpkovski | |
| 10,156,430 | B2 * | 12/2018 | Palomaki | F41B 5/12 |
| 10,520,273 | B2 | 12/2019 | Bednar | |
| 10,612,881 | B2 * | 4/2020 | Houle | F41B 5/066 |
| 10,930,553 | B2 | 2/2021 | Clevenger et al. | |
| 10,969,191 | B2 | 4/2021 | Wong et al. | |
| 11,268,792 | B2 | 3/2022 | O'Reilly | |

(Continued)

FOREIGN PATENT DOCUMENTS

WO WO-2013/122951 A1 8/2013

OTHER PUBLICATIONS

International Search Report and Written Opinion issued in PCT/US2022/011678, dated Nov. 14, 2022.

*Primary Examiner* — John A Ricci
(74) *Attorney, Agent, or Firm* — Foley & Lardner LLP

(57) ABSTRACT

A removable stock for a crossbow includes a body. The body includes a front end and a mounting feature. The front end includes a stock interface that is configured to removably couple the stock to a rear interface of a crossbow. The mounting feature is configured to couple a projectile to the body of the removable stock.

19 Claims, 14 Drawing Sheets

(56) References Cited

U.S. PATENT DOCUMENTS

| | | | | |
|---|---|---|---|---|
| 2012/0125307 | A1* | 5/2012 | Bromley | F41B 5/066<br>124/88 |
| 2014/0283805 | A1 | 9/2014 | Dunlop | |
| 2016/0290757 | A1 | 10/2016 | Khoshnood | |
| 2017/0115090 | A1 | 4/2017 | Bofill | |

* cited by examiner

MODULAR STOCK FOR A WEAPON

CROSS-REFERENCE TO RELATED APPLICATIONS

This application is a continuation of U.S. patent application Ser. No. 17/571,315, filed on Jan. 7, 2022, titled MODULAR STOCK FOR A WEAPON, which claims the benefit of and priority to U.S. Provisional Patent Application No. 63/136,573, filed on Jan. 12, 2021, titled MODULAR STOCK FOR A WEAPON, and U.S. Provisional Patent Application No. 63/134,957, filed on Jan. 7, 2021, titled MODULAR STOCK FOR A WEAPON, each of which are hereby incorporated by reference in their entireties.

BACKGROUND

Projectile launchers, such as crossbows and slingshots, utilize a string that is drawn backward and released to fire a projectile. Flexible limbs are loaded with force by the drawstring being drawn, and limbs are unloaded with force when the crossbow is fired to aggressively power the movement of the drawstring toward the front of the crossbow.

Overall size of not just the projectile launcher, but a weapon in general, is important for both accuracy and maneuverability. Typically, if a user can shoulder a weapon with the use of a stock, the more stable a user can make the weapon, which leads to improved accuracy. However, the longer the weapon, the more cumbersome it is to maneuver. Therefore, improvements are desired.

SUMMARY

This application generally relates to a modular stock for a weapon. In one example, a stock is disclosed that includes a toolless interface (also referred to as a "tool free" interface) for attaching to a projectile launcher and a removable arrow quiver.

In one aspect of the present disclosure, a removable stock for a crossbow is disclosed. The stock includes a body having a front end and a mounting feature. The front end includes a stock interface configured to removably couple the body to a rear interface of a crossbow. The mounting feature of the stock is configured to couple a projectile to the body.

In another aspect of the present disclosure, a stock for a crossbow is disclosed. The stock includes a body having a rear end, a front end, a first side, and a projectile mounting feature. The projectile mounting feature is positioned toward the rear end of the body and configured to engage a projectile to couple the projectile to the body. A projectile is engaged with the projectile mounting feature. The projectile extends past the front end at an angle relative to the first side of the body.

In another aspect of the present disclosure, a removable stock for a crossbow is disclosed. The stock includes a body having a first end, a second end opposite the first end, and a pocket. The first end includes a stock interface configured to mate with a corresponding interface of the crossbow. The pocket is configured to receive at least a portion of a projectile to couple the projectile to the body.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
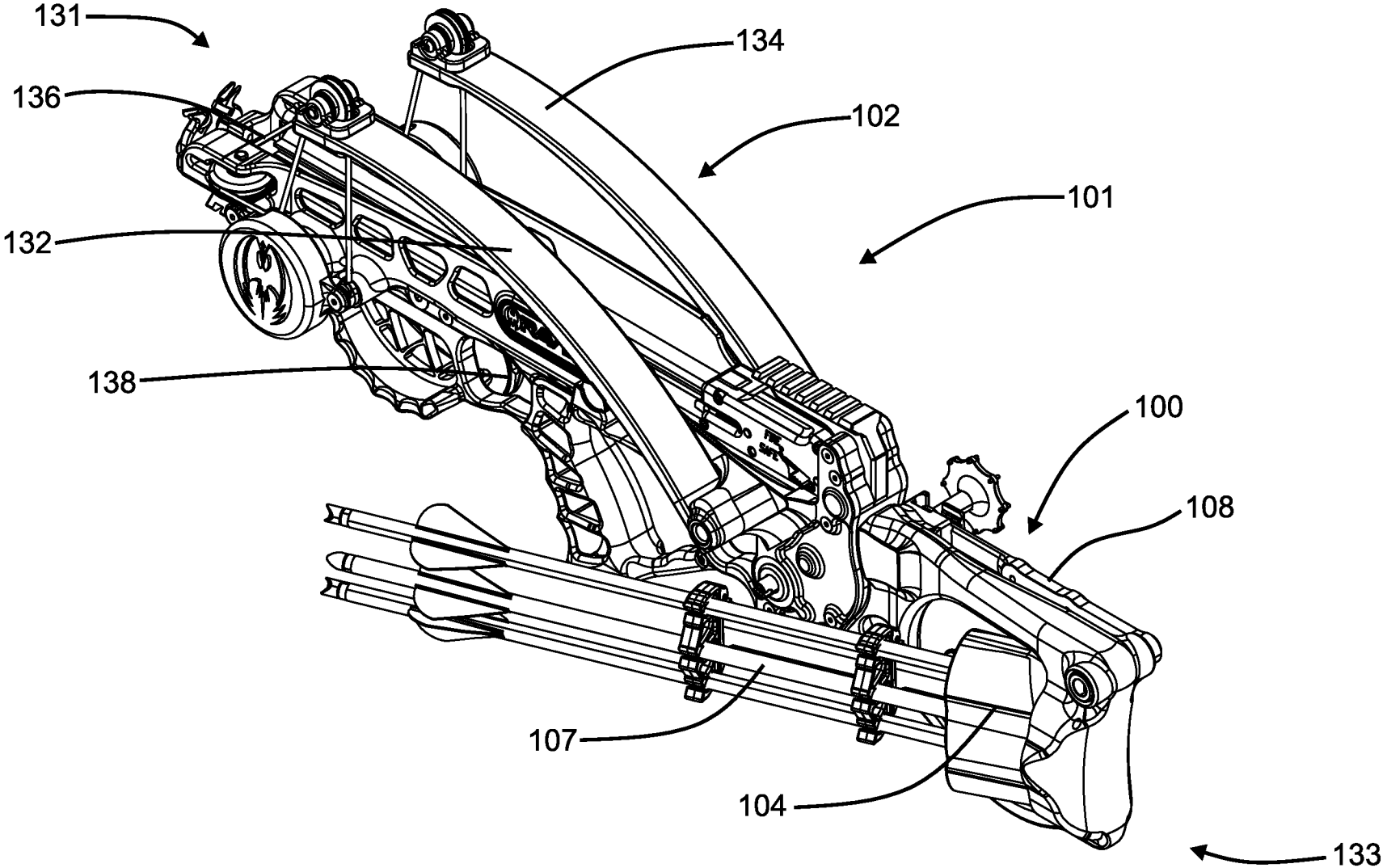
FIG. 1 shows a perspective view of a weapon system, according to one example of the present disclosure.
Figure 2:
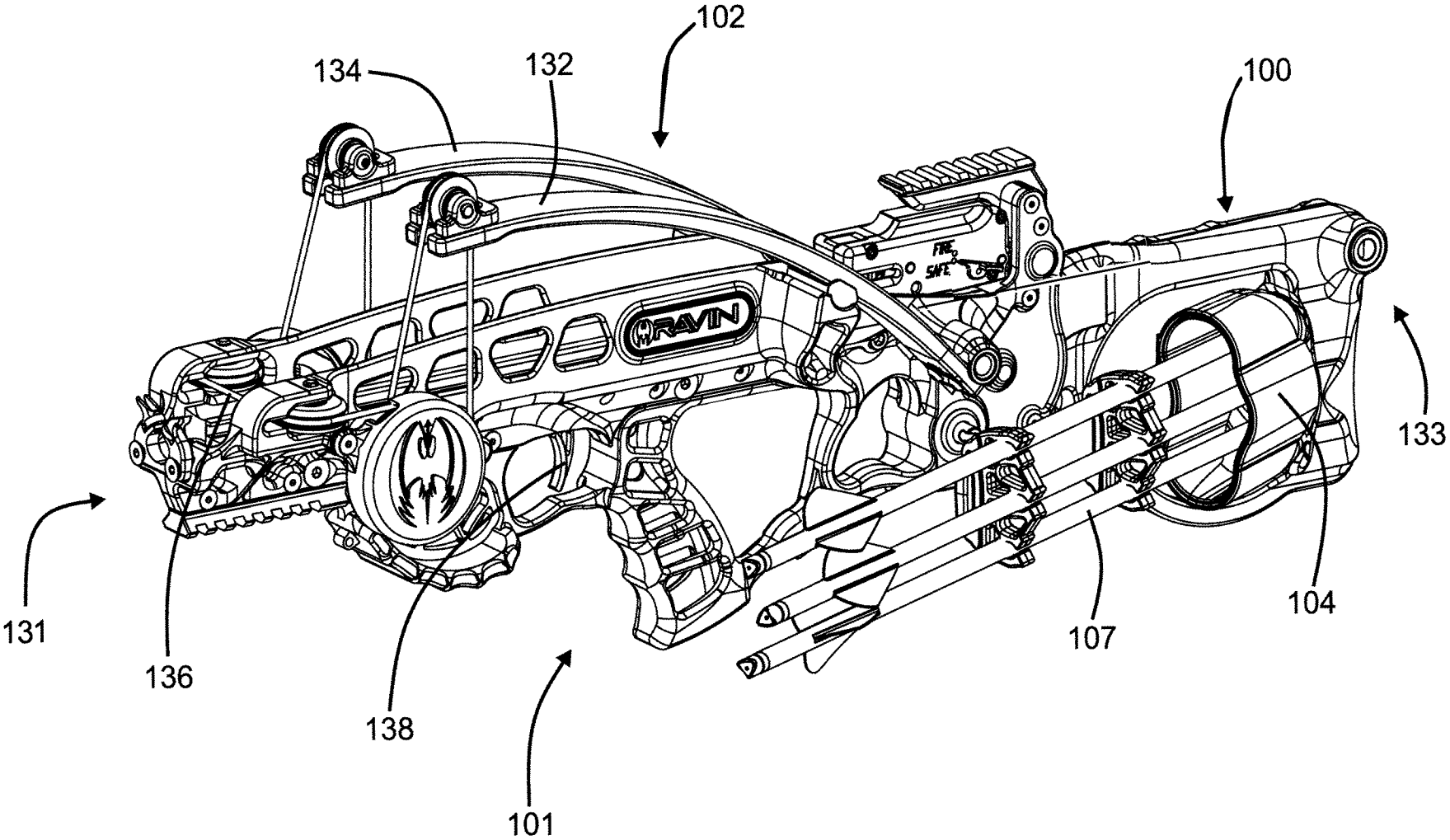
FIG. 2 shows another perspective view of the weapon system of FIG. 1.
Figure 3:
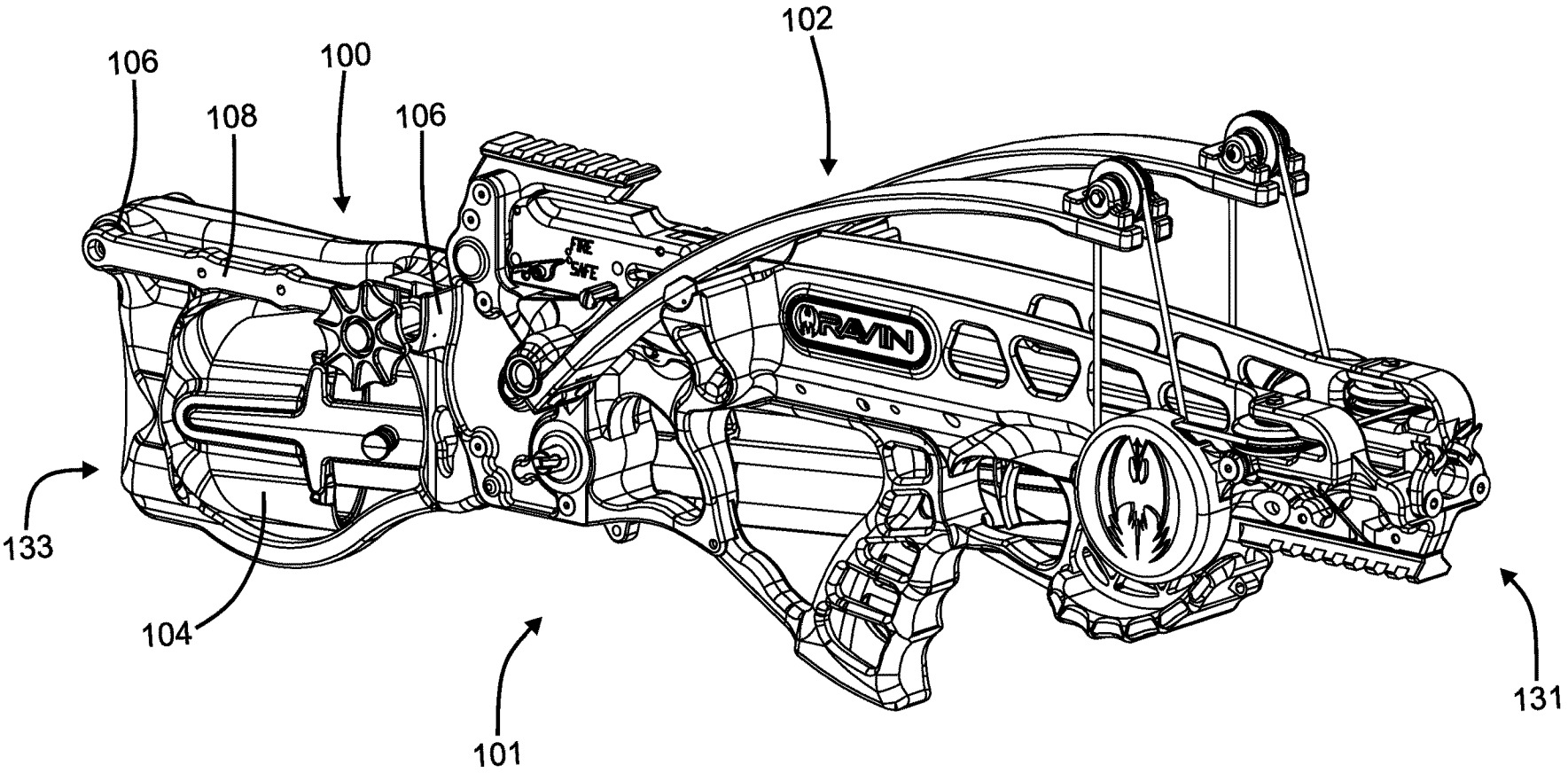
FIG. 3 shows another perspective view of the weapon system of FIG. 1.
Figure 4:
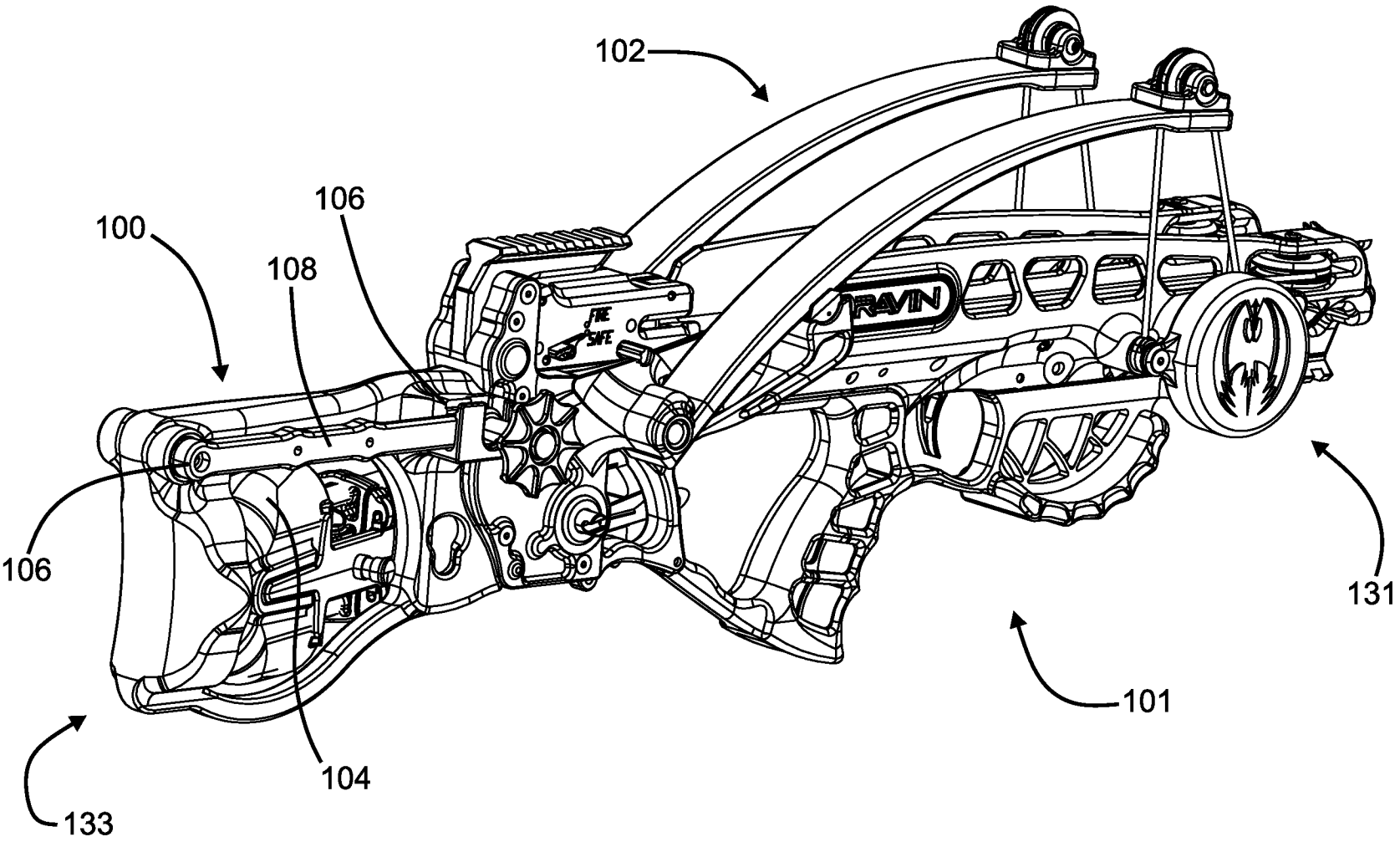
FIG. 4 shows another perspective view of the weapon system of FIG. 1.

Various embodiments will be described in detail with reference to the drawings, wherein like reference to numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A stock 100 for a weapon is disclosed herein. The stock 100 is configured to be positioned against a user's shoulder to stabilize the attached weapon. In some examples, the stock 100 is configured for use with a projectile launcher, such as a crossbow. In some examples, the stock 100 includes a mounting feature 109 for a quiver 104. In some examples, the stock includes a storage feature 106 for storing an arming tool 108 (e.g., a hand crank) for a crossbow. In some examples, the stock 100 can be mounted to an auxiliary location (e.g., a user's belt, backpack, etc.) to allow for full maneuverability of the weapon until the user needs to attach the stock to the weapon for firing. For example, a user can attach the stock 100 to the user's belt while hiking to a hunting location. Once at the hunting location, the user can attach the stock 100 to the weapon and improve the stability of the weapon during firing.

FIGS. 1-4 show perspective views of a weapon system 101 including a projectile launcher 102 with the stock 100. The stock 100 is shown including a quiver 104 removably attached thereto, and a storage feature 106 for an arming tool 108.

The projectile launcher 102 is configured to propel a projectile from a front end 131. The projectile launcher 102 operates by utilizing flexible limbs 132, 134 that are flexed by drawing a drawstring 136 toward a rear end 133. As the drawstring 136 is drawn rearward, the limbs 132, 134 that are connected thereto are drawn downward and loaded. Once fully rearward, the drawstring 136 can be released by a trigger 138 to propel a projectile 107 (i.e., an arrow) toward the front end 131. While a projectile launcher 102 is shown, it is considered within the present disclosure that a variety of different weapons can be utilized, such as a firearm.

Figure 5:
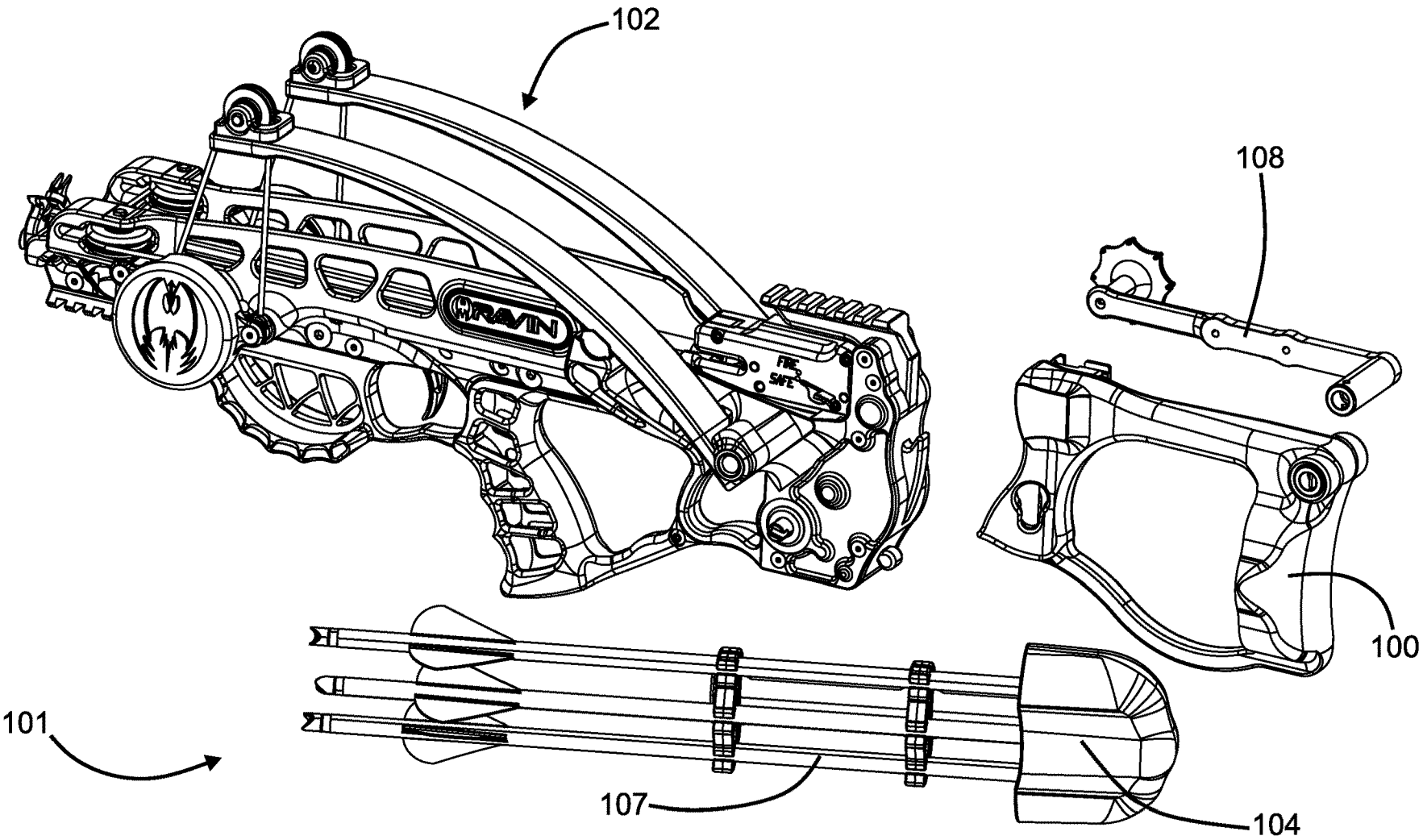
FIG. 5 shows an exploded view of the weapon system of FIG. 1.

FIG. 5 shows the stock 100, quiver 104, and arming tool 108 separated from the projectile launcher 102.

Figure 6:
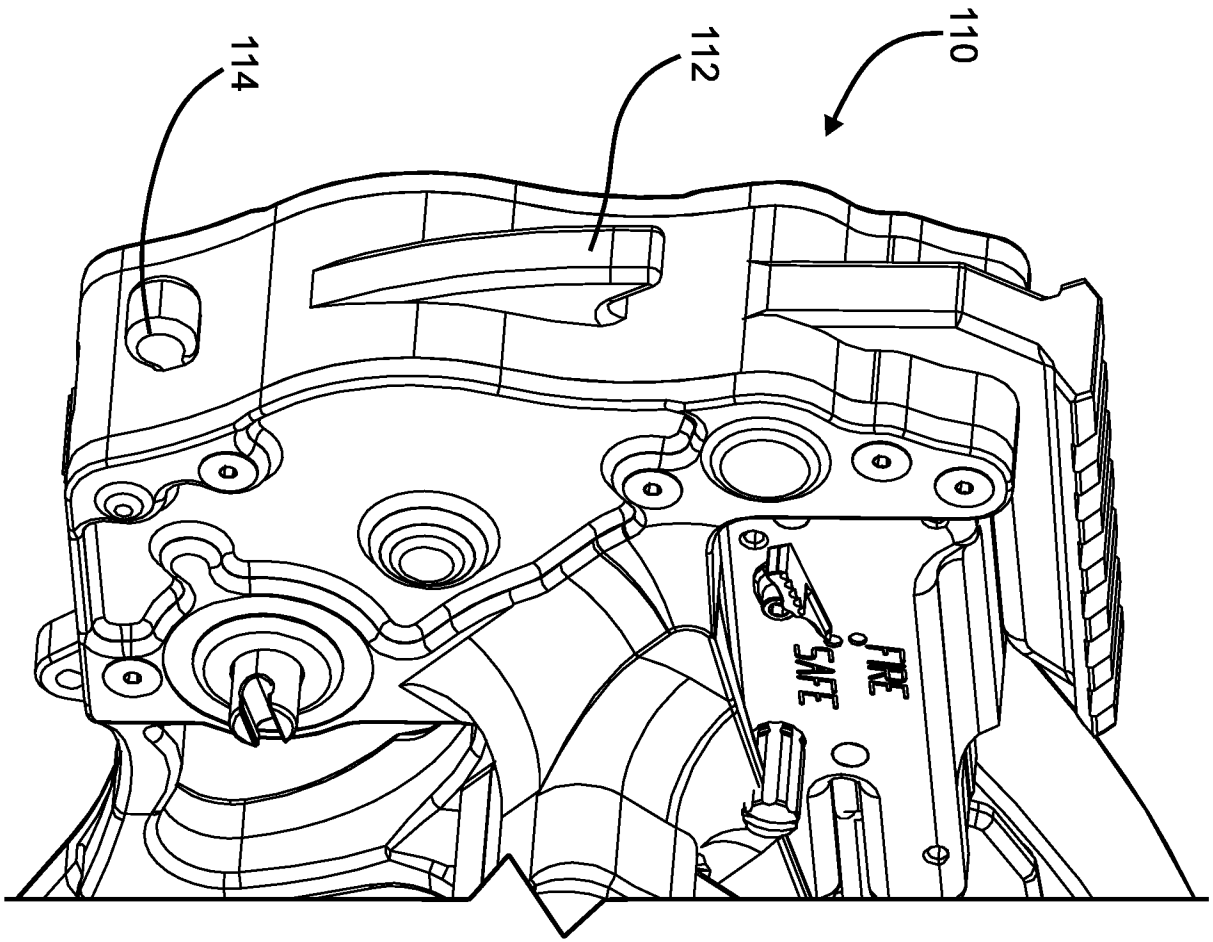
FIG. 6 shows a perspective view of a rear interface of a weapon, according to one example of the present disclosure.

As shown in FIG. 6, the projectile launcher 102 includes a rear interface 110 that is configured to mate with the stock 100. In some examples, the rear interface 110 includes at least two mating elements. In some examples, the mating elements include an upward facing hook 112 and a post 114.

Figure 7:
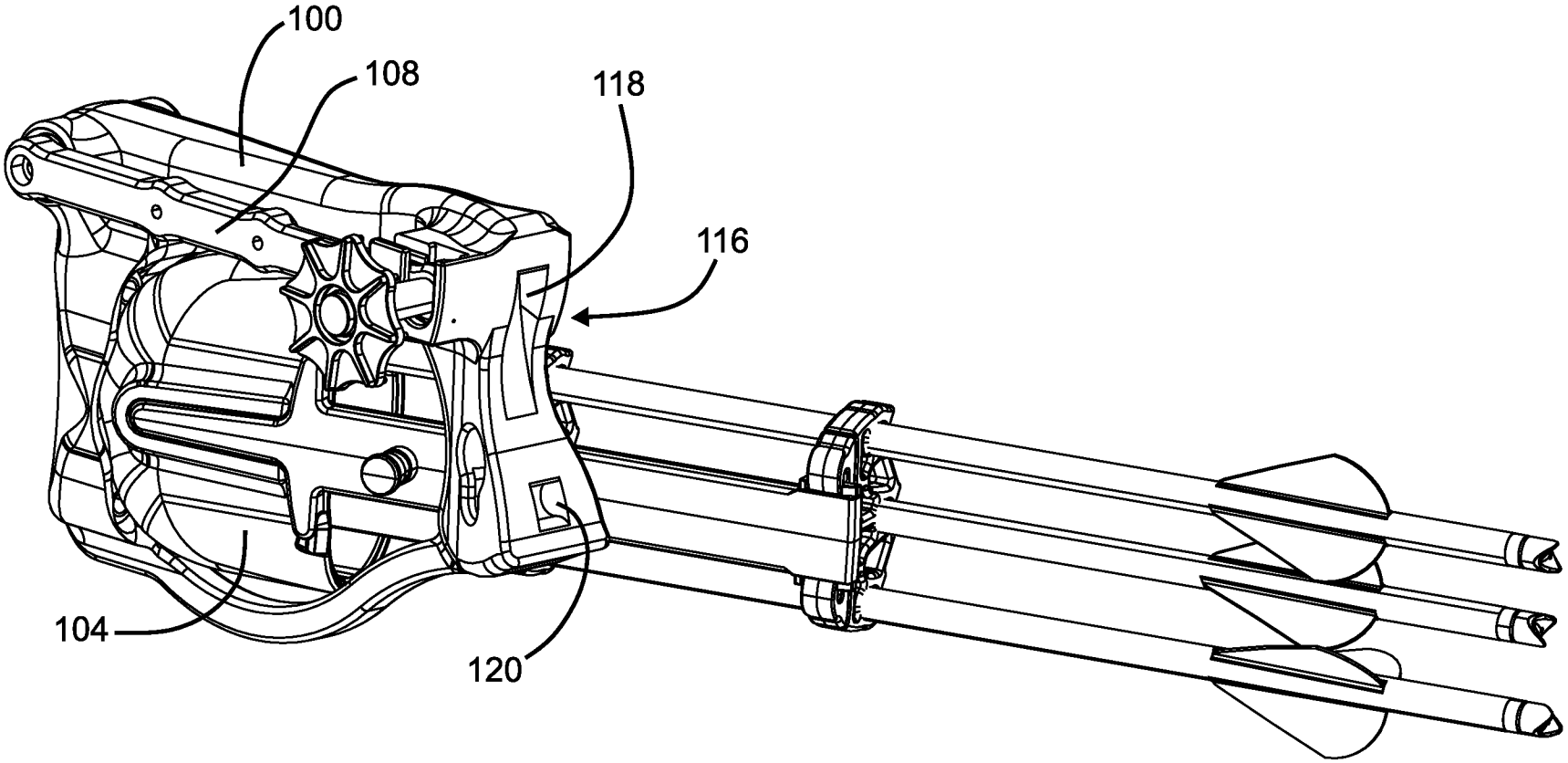
FIG. 7 shows a perspective view of a stock and a quiver, according to one example of the present disclosure.

As shown in FIG. 7, the stock 100 includes a stock interface 116 that is configured to mate with the rear interface 110 of the projectile launcher 102. In some examples, the stock interface 116 includes at least two mating elements. In some examples, the mating elements include a first mating element such as a hook recess 118 that is sized and shaped to mate with the hook 112 of the rear interface 110 and a second mating element such as a post recess 120 that is sized and shaped to mate with the post 114 of the rear interface 110. In some examples, the hook recess 118 has a vertical pocket 140.

In some examples, the first mating element is a pivotal connection element, which when connected to the rear interface of the weapon, permits the stock to pivot with respect to the weapon about the pivotal connection element.

In some examples the second mating element is an interference fit element that releasably engages the rear interface of the weapon with an interference fit. When the second mating element is engaged with the rear interface of the weapon, the stock is prevented from pivoting about the pivotal connection element. When the second mating element is disengaged from the rear interface of the weapon, the stock is free to pivot about the pivotal connection element.

In some examples the stock interface comprises one or more mating elements that provide a snap-fit connection with the rear interface of the weapon. In some examples the snap-fit connection is a toolless/tool free connection that can be connected and disconnected by hand without tools.

Figure 8:
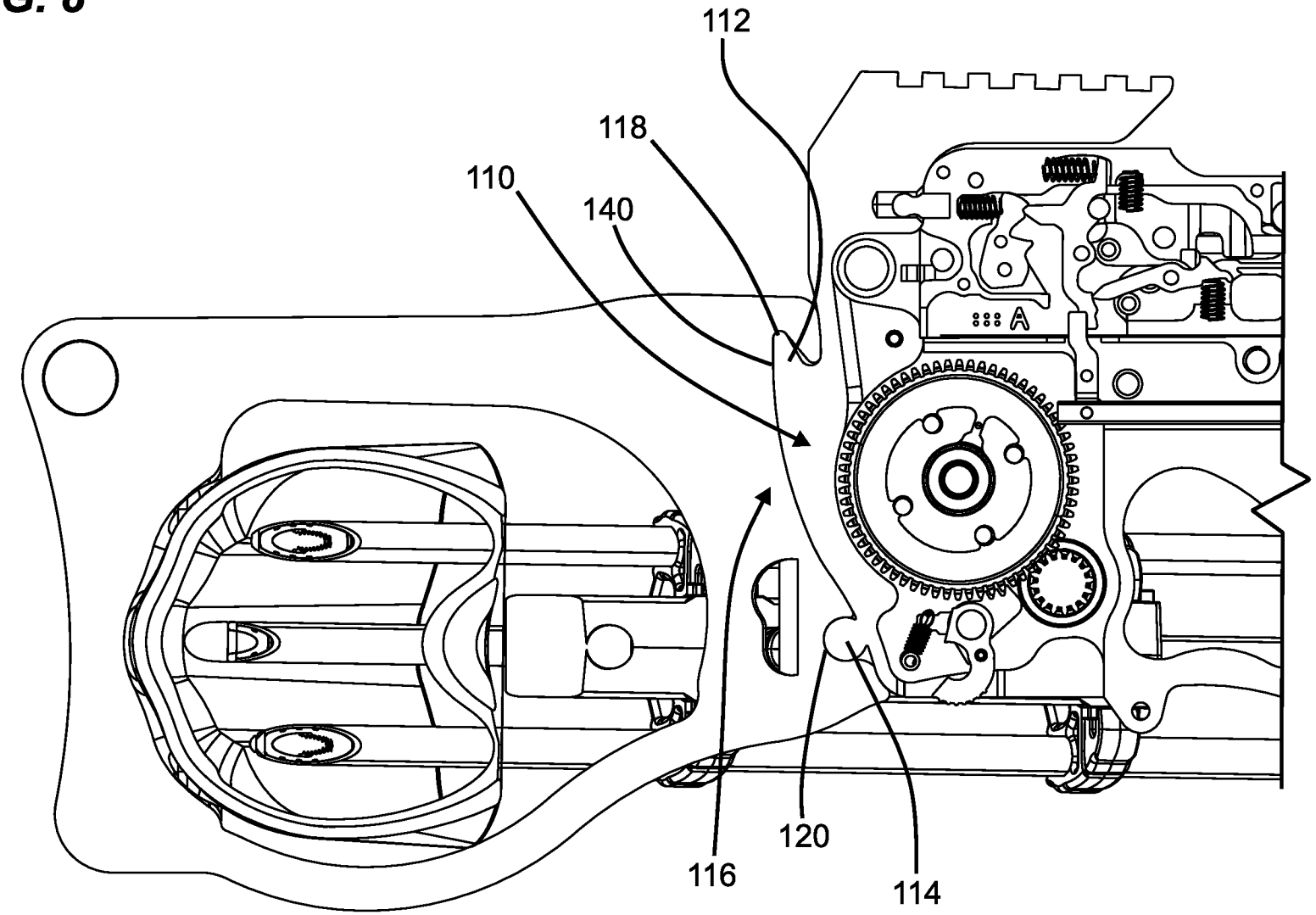
FIG. 8 shows a longitudinal cross section of the weapon system of FIG. 1.

As shown in FIG. 8, the hook 112 of the rear interface 110 is mated in the hook recess 118 of the stock 100 and the post 114 of the rear interface 110 is positioned within the post recess 120 of the stock 100. In some examples, the mating between the stock interface 116 and the rear interface 110 utilizes an interference fit. In some examples, an interference fit is used between the post 114 and the post recess 120. In some examples, the stock 100 can be removed from the projectile launcher 102 without the use of tools. It is considered within the scope of the present disclosure that a variety of different toolless connections can be used between the stock 100 and the projectile launcher 102. It is also considered within the present disclosure that the stock interface can include at least one projection that mates with at least one recess of the rear interface 110. For example, the post 114 and post recess 120 can be reversed in some embodiments such that the post 114 is part of the stock 100 body and the post recess 120 is part of the rear interface 110 of the weapon.

To attach the stock interface 116 to the rear interface 110, a user first mates the hook 112 and hook recess 118. This can be done by positioning the hook recess 118 above the hook 112 and guiding the hook into the recess 118. Once the user mates the hook 112 and hook recess 118, the user then pivots the stock 100 and exerts a force to position the post 114 within the post recess 120. This force is to ensure a mating between the stock interface 116 and the rear interface 110 via an interference fit. This interference fit will allow the stock 100 to stay attached to the projectile launcher 102 so that the connection between the stock 100 and the projectile launcher 102 is not loose. To remove the stock, a user exerts a force upward at a rear end 133 of the stock 100 of the projectile launcher 102 to break loose the interference fit between the post 114 and the post recess 120. Once released, the hook 112 can be slid out of the hook recess 118 and the stock 100 uncoupled with the projectile launcher 102.

FIG. 8 shows a longitudinal cross-section of the weapon system 101 of FIG. 1, including the stock interface 116.

Figure 9:
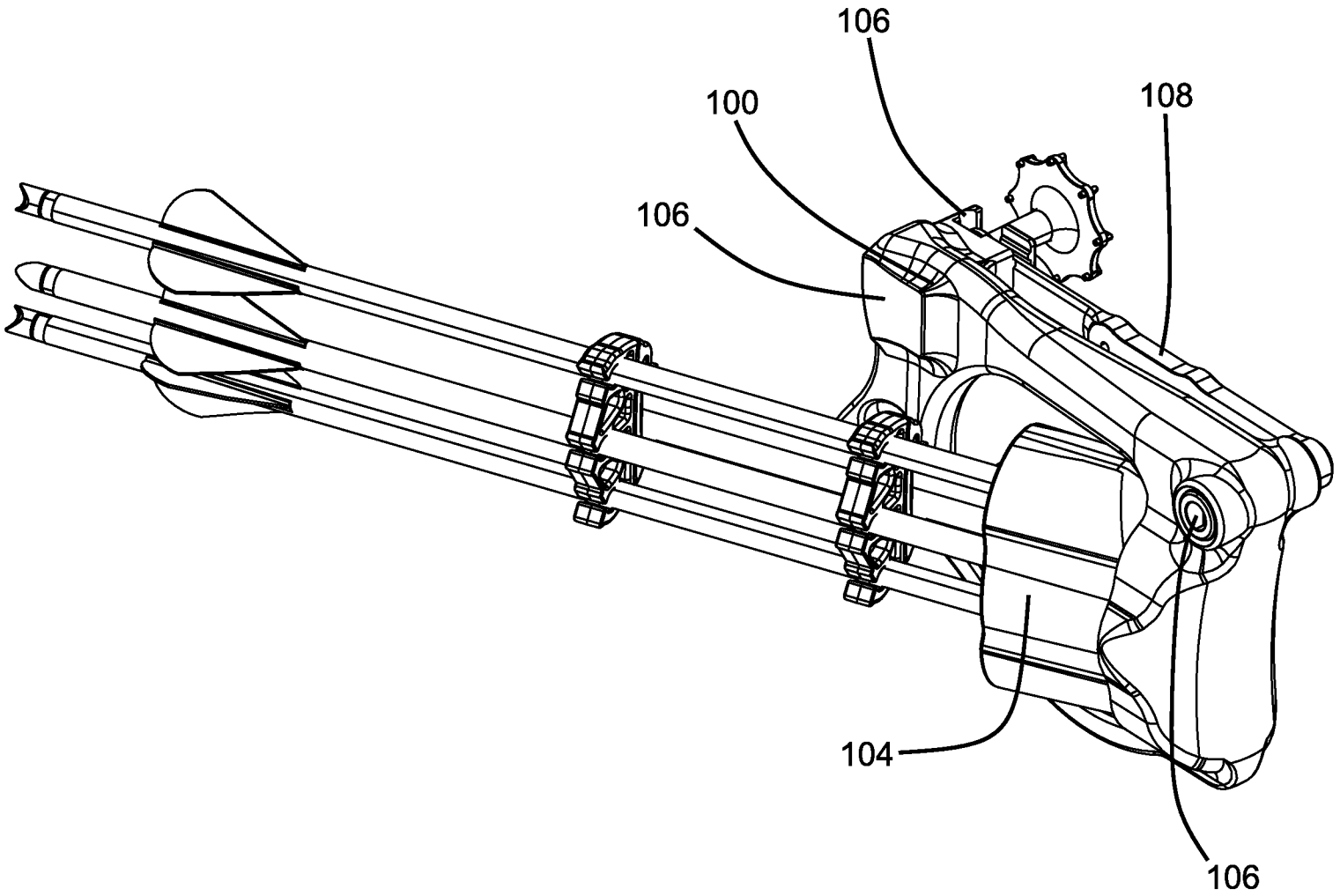
FIG. 9 shows another perspective view of the stock and the quiver of FIG. 7.
Figure 10:
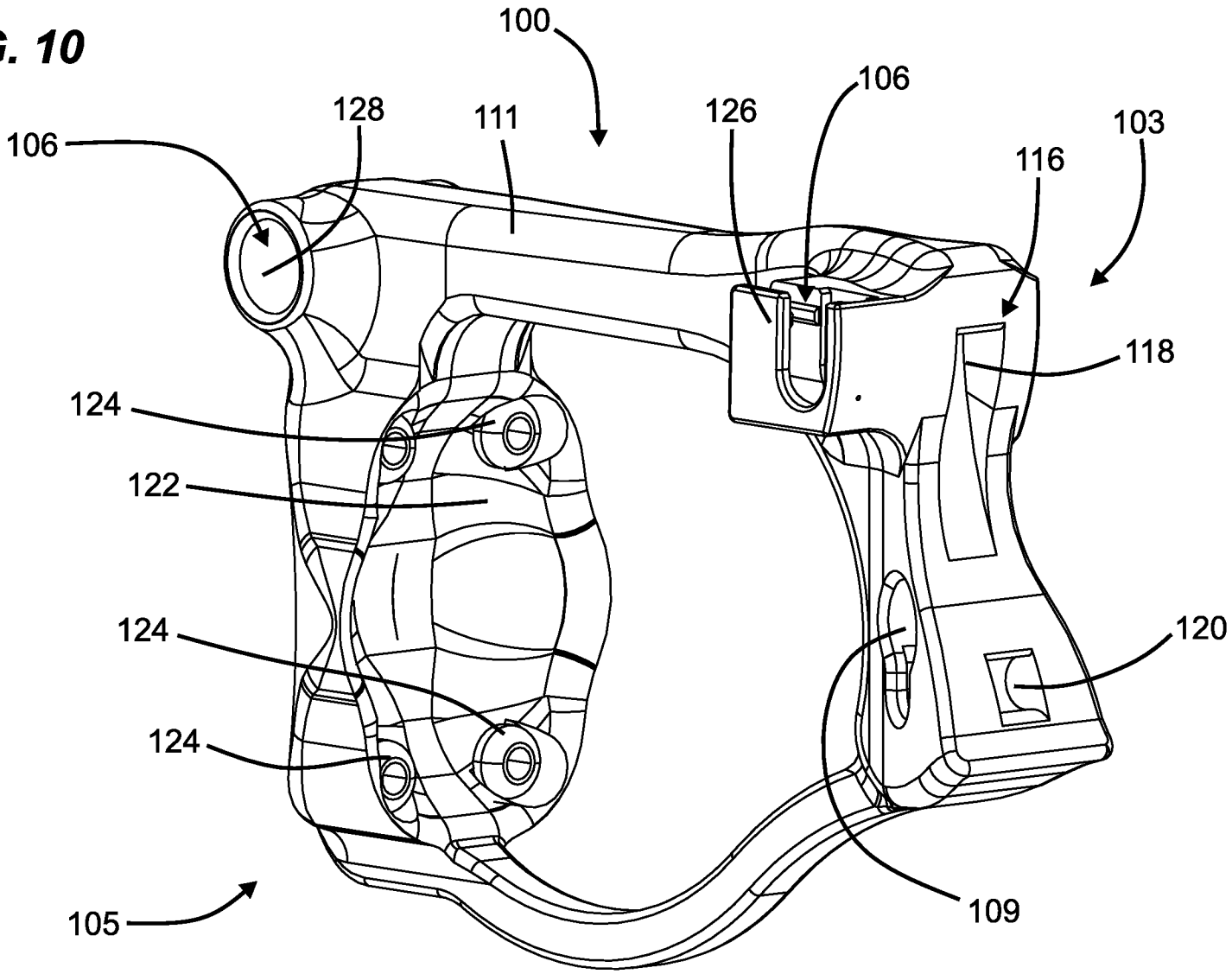
FIG. 10 shows a front perspective view of the stock of FIG. 7.
Figure 11:
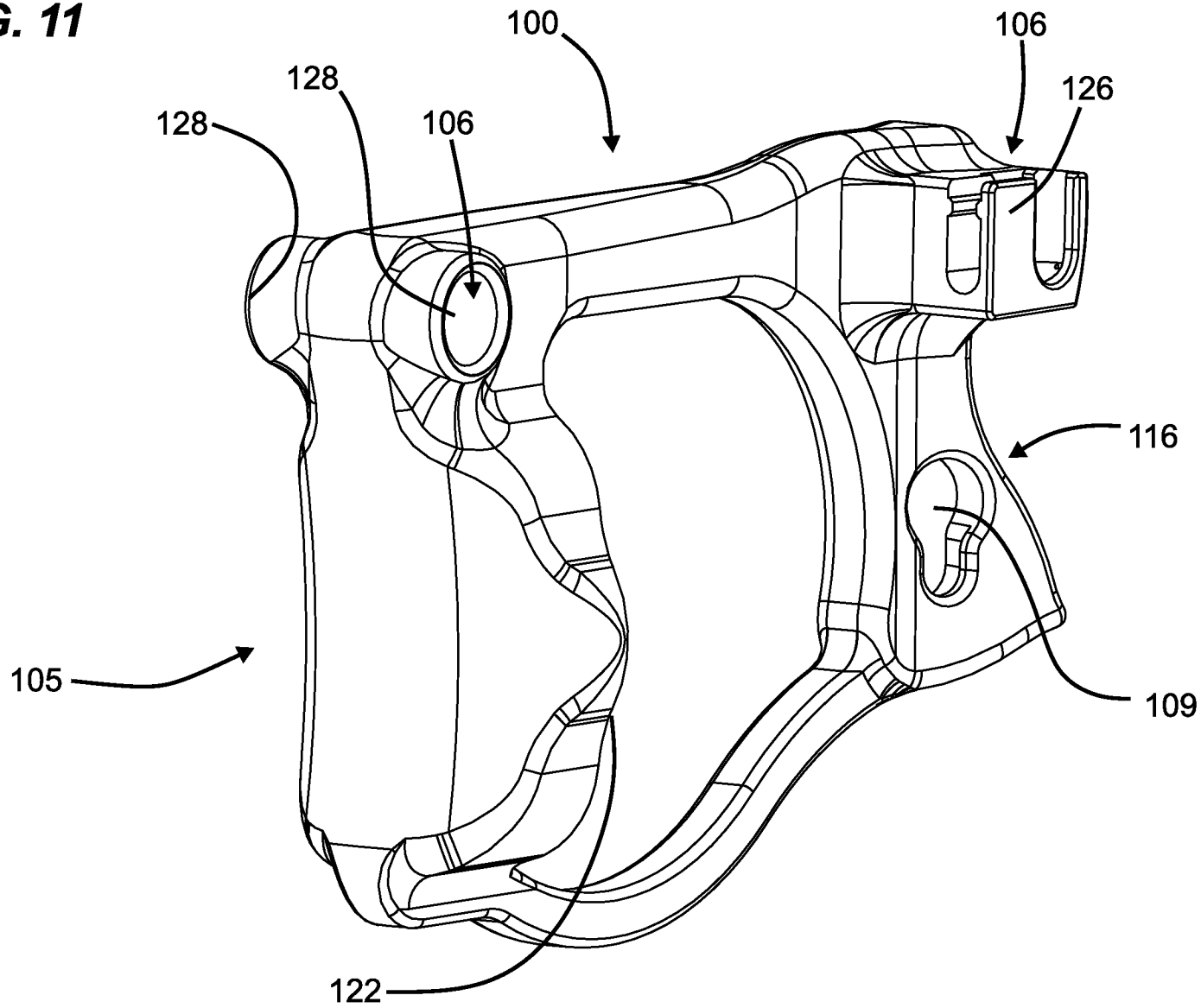
FIG. 11 shows a rear perspective view of the stock of FIG. 7.
Figure 12:
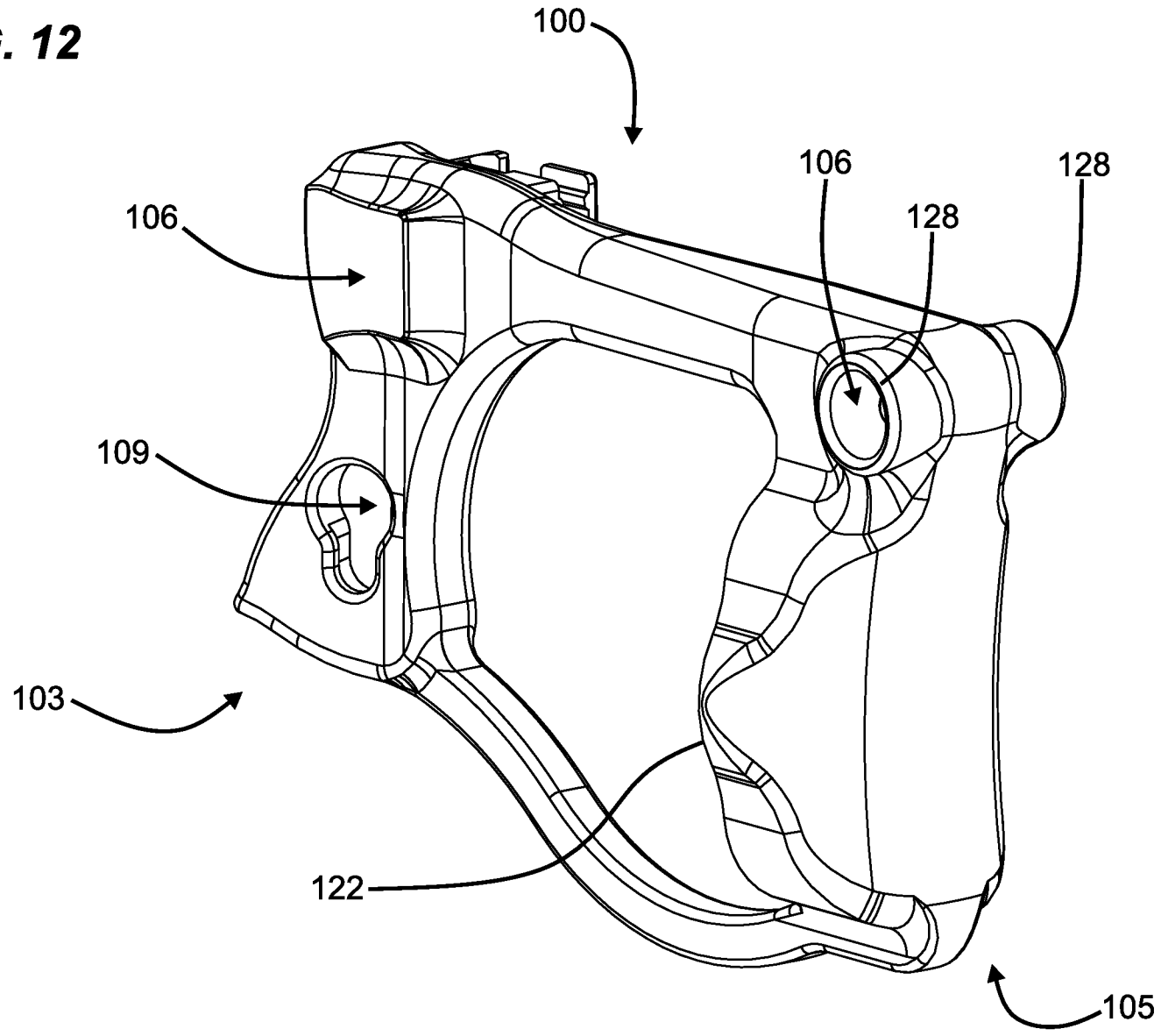
FIG. 12 shows another rear perspective view of the stock of FIG. 7.
Figure 13:
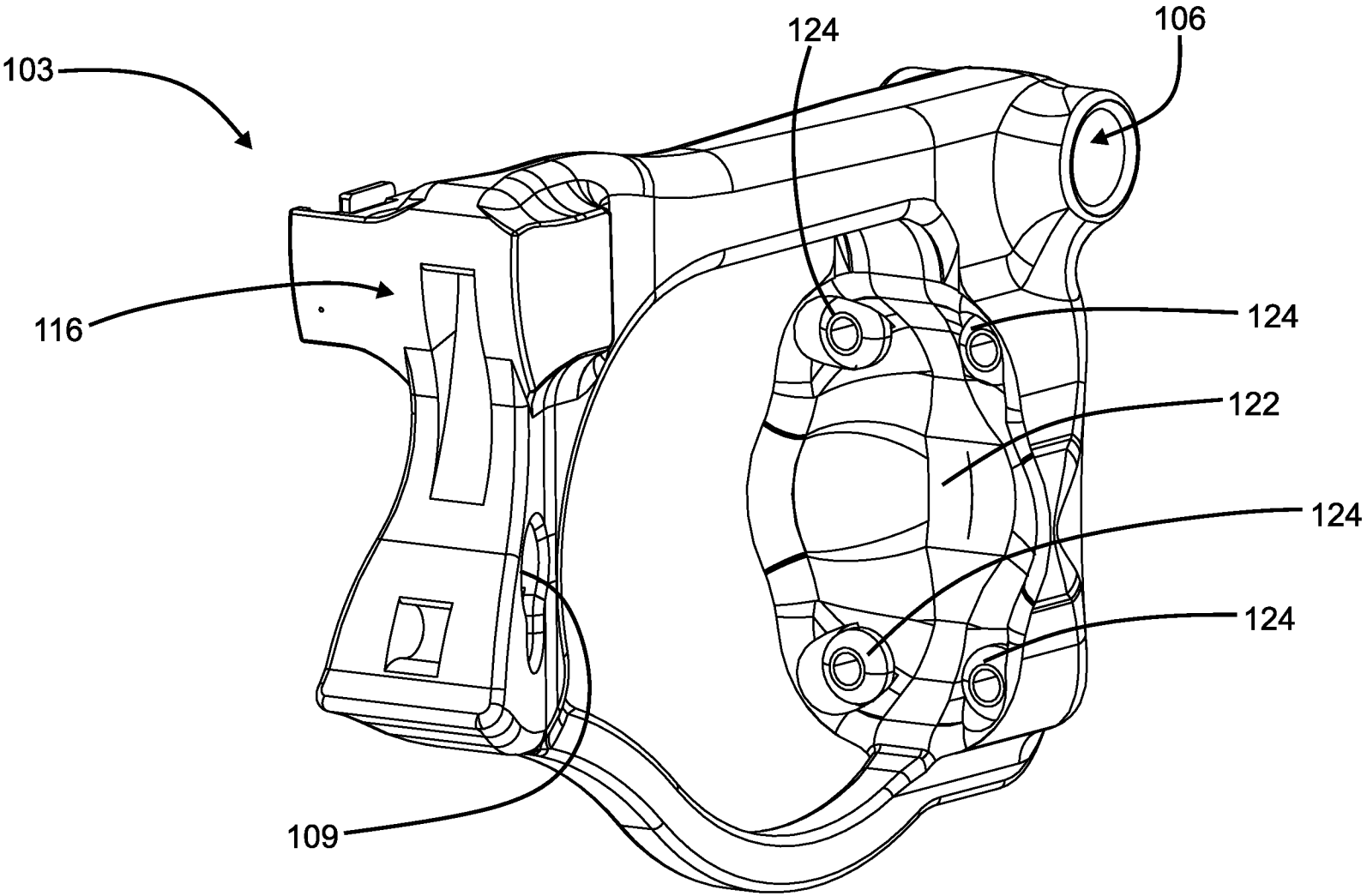
FIG. 13 shows another front perspective view of the stock of FIG. 7.

FIG. 9 shows a perspective view of the stock 100 with the attached quiver 104 and arming tool 108.

FIGS. 10-13 show the stock 100. The stock 100 includes a body 111 including a front end 103 and a rear end 105. At the front end 103, the stock 100 includes the stock interface 116, a plurality of quiver mounting features 109, and the arming tool storage feature 106. At the rear end 105, the stock 100 includes a quiver pocket 122, a plurality of quiver grips 124, and the arming tool storage feature 106.

In the depicted examples, the quiver 104 can be secured to either side of the stock 100 via the quiver mounting features 109. In some examples, the quiver mounting features 109 are apertures that are configured to mate to and secure the quiver 104. By allowing for mounting of the quiver 104 at either side of the stock 100, the stock 100 can be used by either right-handed or left-handed users.

In the depicted example, the arming tool storage feature 106 includes a cradle 126 at the front end 103 of the stock 100 and an aperture 128 at the rear end 105 of the stock 100. In some examples, the cradle 126 is part of a block that is detachable from the stock 100 and can be mounted to either side of the stock 100 for ambidextrous use.

The quiver pocket 122 is configured to receive an end of the quiver 104 to at least partially nest the quiver 104 within the stock 100. In some examples, the quiver grips 124 are positioned within the quiver pocket 122 so as to at least partially grip the quiver 104. In some examples, the quiver grips are rubber.

Figure 14:
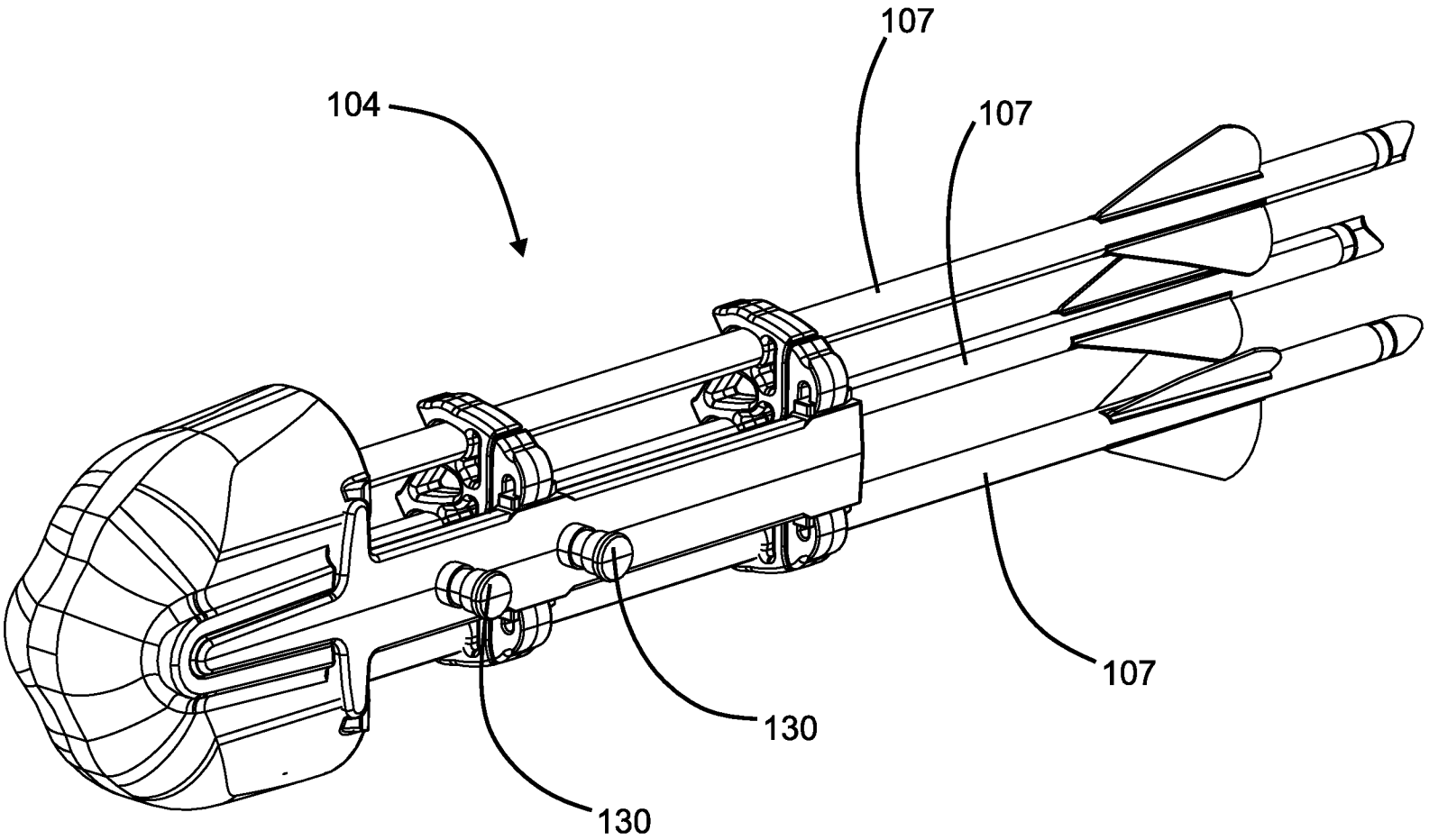
FIG. 14 shows a perspective view of the quiver of FIG. 7.

FIG. 14 shows a perspective view of the quiver 104. The quiver is configured to store the plurality of projectiles 107 (e.g., arrows). In some examples, the quiver 104 can include at least one stock mounting feature 130. In some examples, the quiver 104 includes a plurality of stock mounting features 130. In some examples, the stock mounting features 130 are posts. In some examples, the stock mounting features 130 are configured to mate to and secure the quiver mounting features 109 of the stock.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

In some examples, the components of the rear interface 110 of the weapon and the stock interface 116 of the stock 100 described with reference to FIGS. 5-9 are configured to be interchangeably positioned on either one of the rear interface 110 of the weapon and the stock interface 116 of the stock 100. For example, one or more of the hook recess 118 or the post recess 120 may be placed on the rear interface 110 of the weapon, while one or more of the hook 112 or post 114 is positioned on the stock interface 116 of the stock.

What is claimed is:

1. A removable stock for a crossbow, the stock comprising:

a body having a front end and a mounting feature, the front end including a stock interface configured to removably couple the body to a rear interface of a crossbow; and the mounting feature configured to couple a projectile to the body, the mounting feature including an aperture extending at least partially into the body, the aperture configured to receive a post.

2. The removable stock of claim 1, wherein the mounting feature is positioned on a first side of the body, wherein, when the projectile is coupled to the body via the mounting feature, the projectile is configured to extend towards a front end of the crossbow at an angle from the first side of the body.

3. The removable stock of claim 2, wherein the angle is 45 degrees or less.

4. The removable stock of claim 1, further comprising a second mounting feature, the second mounting feature a quiver pocket configured to receive a portion of a quiver.

5. The removable stock of claim 4, wherein the quiver pocket is positioned at a rear end of the removable stock, the rear end opposite the front end.

6. The removable stock of claim 1 wherein the mounting feature is positioned on a first side of the body, and the post extends from a quiver to couple the quiver to the first side of the body.

7. The removable stock of claim 1, further comprising:

a second mounting feature, wherein the second mounting feature is a quiver pocket; and a grip positioned within the quiver pocket.

8. The removable stock of claim 1, further comprising:

the body further defining a storage feature, the storage feature configured to couple an arming tool with the body.

9. The removable stock of claim 8, wherein the storage feature includes a second aperture, the second aperture configured to receive a portion of the arming tool to couple the arming tool with the body.

10. A stock for a crossbow, the stock comprising:

a body having a rear end, a front end, a first side, and a projectile mounting feature, the projectile mounting feature positioned toward the rear end of the body and configured to engage a projectile to couple the projectile to the body, and a projectile engaged with the projectile mounting feature, wherein the projectile extends past the front end at an angle relative to the first side of the body.

11. The stock of claim 10, wherein the projectile mounting feature is a pocket defined in the body, the pocket configured to receive at least a portion of a quiver to couple the projectile to the body.

12. The stock of claim 11, further comprising a quiver that is received in the pocket, wherein the pocket engages an end of the quiver such that the quiver extends away from the first side of the body at the angle.

13. The stock of claim 11, further comprising:

a grip positioned within the pocket, wherein, when the quiver is received in the pocket, the grip is configured to engage with an end of the quiver.

14. The stock of claim 10, wherein the angle is 45 degrees or less.

15. The stock of claim 10, further comprising:

a second projectile mounting feature positioned proximate the front end of the body, the second projectile mounting feature engaging the projectile to couple the projectile adjacent to the first side of the body.

16. The stock of claim 10, further comprising:

the front end of the body including a stock interface, the stock interface configured to removably couple the stock to a crossbow.

17. A removable stock for a crossbow, the stock comprising:

a body having a first end, a second end opposite the first end, and a pocket positioned on the second end of the body, the first end including a stock interface configured to mate with a corresponding interface of the crossbow, the pocket configured to receive at least a portion of a projectile to couple the projectile to the body.

18. The removable stock of claim 17, wherein the pocket is a quiver pocket configured to receive a portion of a quiver.

19. The removable stock of claim 18, further comprising:

a grip positioned within the pocket, wherein, when the portion of the projectile is received in the pocket, the grip is configured to engage with the projectile.

* * * * *